United States Patent [19]

Duffy

[11] 4,020,577

[45] May 3, 1977

[54] BOLT HANDLE ADAPTOR FOR A BOLT ACTION RIFLE

[76] Inventor: Joseph James Duffy, 411 Darwin Drive, Newark, Del. 19711

[22] Filed: Jan. 5, 1976

[21] Appl. No.: 646,420

[52] U.S. Cl. ..... 42/16; 42/1 R

[51] Int. Cl.[2] ..... F41C 11/00; F41C 27/00

[58] Field of Search ..... 42/16, 1 R

[56] References Cited

UNITED STATES PATENTS 1,886,925 11/1932 Wale ..... 42/16

*Primary Examiner*—Charles T. Jordan

[57] ABSTRACT

A bolt handle adaptor is provided which enables a conventional right-hand operated bolt action rifle to be operated from the left-hand side. The adaptor is pivotally mounted to the distal end of the chamber-closing bolt of the rifle and projects to the left and to the right of the rifle. The left-hand section terminates in a gripping portion while the right-hand section terminates in a bolt gripping means which is affixed to the bolt handle of the chamber-closing bolt.

7 Claims, 2 Drawing Figures

BOLT HANDLE ADAPTOR FOR A BOLT ACTION RIFLE

BACKGROUND OF THE INVENTION

Conventionally, bolt action rifles are manufactured to be operated from the right-hand side. Left-hand operated rifles can be procured only at a premium price, if at all. It is generally recognized among marksmen, especially those who participate in competitive shooting matches, that a distinct advantage inures to the left-handed shooter if he need not remove his rifle from his shoulder to reload it. In this regard, it has become the object of numerous inventors to provide an arrangement whereby a right-hand operated bolt action rifle can be operated from the left side. These arrangements have been largely unsuccessful because they either require extensive modification of the rifle or are unwieldy and require the fabrication of special parts for which there are no replacements.

One such arrangement is described in U.S. Pat. No. 1,886,925. In this arrangement, a handle is attached to the bolt handle of the rifle and extends over the top of the rifle to be operated from the left side. This arrangement suffers from the defects that it interferes with the marksman's line of sight toward the target. It further suffers from the defect that it acts without support, in a cantilever fashion, and exerts undue stress on the rifle bolt handle. Also, the arc within which the extended handle travels is greatly increased over the arc within which the original bolt handle travels, thus causing the marksman to tend to pull the rifle off the target upon reloading.

The invention of the present disclosure, however, overcomes these prior art defects. The present bolt handle adaptor is an inexpensive, straight-forward, easily installed and readily maintained arrangement which allows a right-hand operated rifle to be converted for operation from the left-hand side.

SUMMARY OF THE INVENTION

The present invention is a bolt handle adaptor for a bolt action rifle which includes an L-shaped hand manipulated lever attached to the chamber closing bolt to enable the rifle to be operated from the left-hand side. The adaptor arrangement is attached to the bolt handle of the rifle and mounts to the rear of the chamber closing bolt so as not to interfere with the shooter's line of sight while reloading between successive shots.

More specifically, the bolt handle adaptor includes mounting means attached to the distal end of the chamber closing bolt;

An adaptor having first and second ends, the adaptor being pivotally mounted to the mounting means intermediate the first and second ends, the adaptor further terminating in a gripping portion at its first distal end on the left side of the rifle and including a laterally projecting section immediate to its second end on the right side of the rifle;

A bolt handle engaging means attached to the second end of the adaptor and engaged with the bolt handle of the rifle, the adaptor being further defined in that the laterally projecting section and the bolt handle engaging means, in combination, project laterally a distance at least equal to the distance from the distal end of the bolt to the bolt handle and the adaptor further lying in the horizontal plane defined by the longitudinal axis of the chamber closing bolt and the longitudinal axis of the bolt handle when the bolt is in its open position.

Moreover, the bolt handle adaptor includes the additional features that: (1) it may be easily installed and removed using a minimum of tools; (2) the adaptor arrangement may be mounted on a rifle for use without altering the existing firing mechanism except for removal of the firing pin indicator; (3) the mounting may be accomplished without the aid of a gunsmith and the accuracy of the rifle is not affected in any way. Further, the bolt handle adaptor does not interfere with any of the existing mechanisms of the rifle including telescopic sights, iron sights or custom stocks.

In addition, the bolt handle adaptor is designed so that the hand position and in particular the thumb position of the left or trigger finger hand is not disturbed. Also, the adaptor arrangement of this invention may be operated smoothly and conveniently without removing the butt of the rifle from the shooter's shoulder. Similarly, the adaptor arrangement allows for easy disassmbly thereby providing for quick and easy cleaning of the rifle action.

In addition, the bolt handle adaptor conforms to all the rules and regulations applicable to target rifle shooting.

DESCRIPTION OF THE PREFERRED EMBODIMENT

Figure 1:
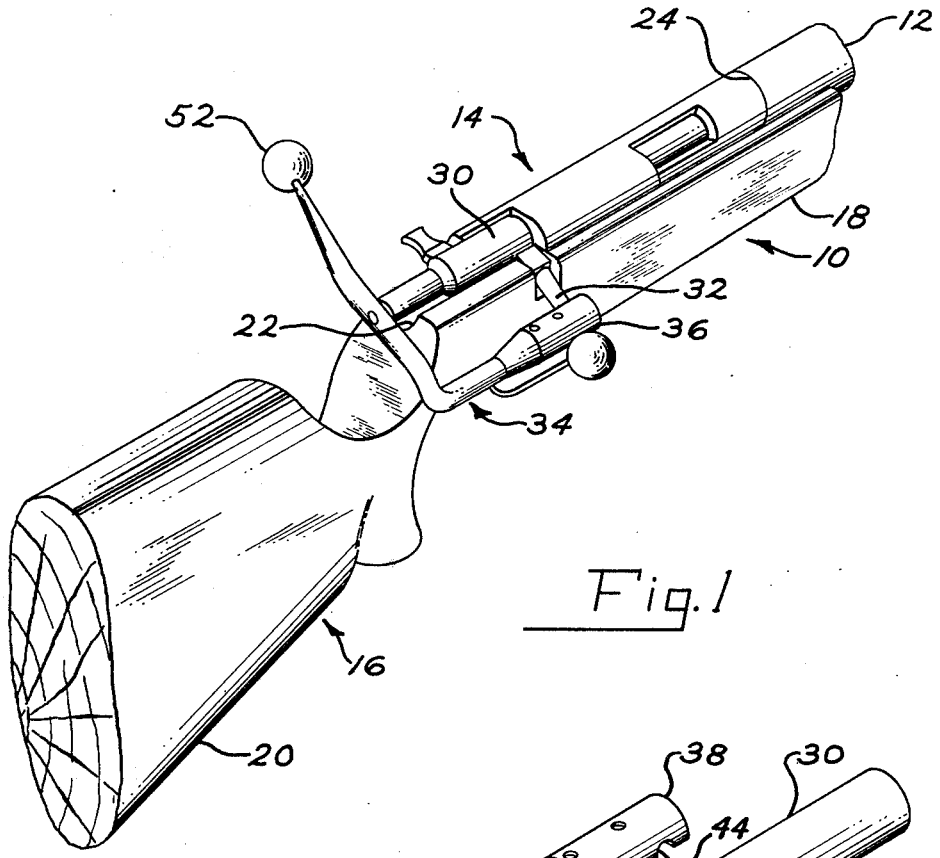
FIG. 1 is an isometric view of a conventional right-hand operated rifle employing the present invention.

FIG. 1 shows a rifle 10 having a barrel 12, an action 14 and a stock 16. The stock includes a forearm section 18 and a butt section 20. The forearm section includes a groove 22 formed therein in which barrel 12 is received. The barrel 12 includes a breech end 24 and a muzzle end. The breech includes an enlarged chamber (not shown) in which a cartridge is positioned during firing. Action 14 includes a chamber closing bolt 30 having a handle 32 attached thereto and projecting toward the right-hand side of the rifle. The chamber closing bolt also includes a firing pin indicator (not shown) at the rearward or the distal end thereof.

Figure 2:
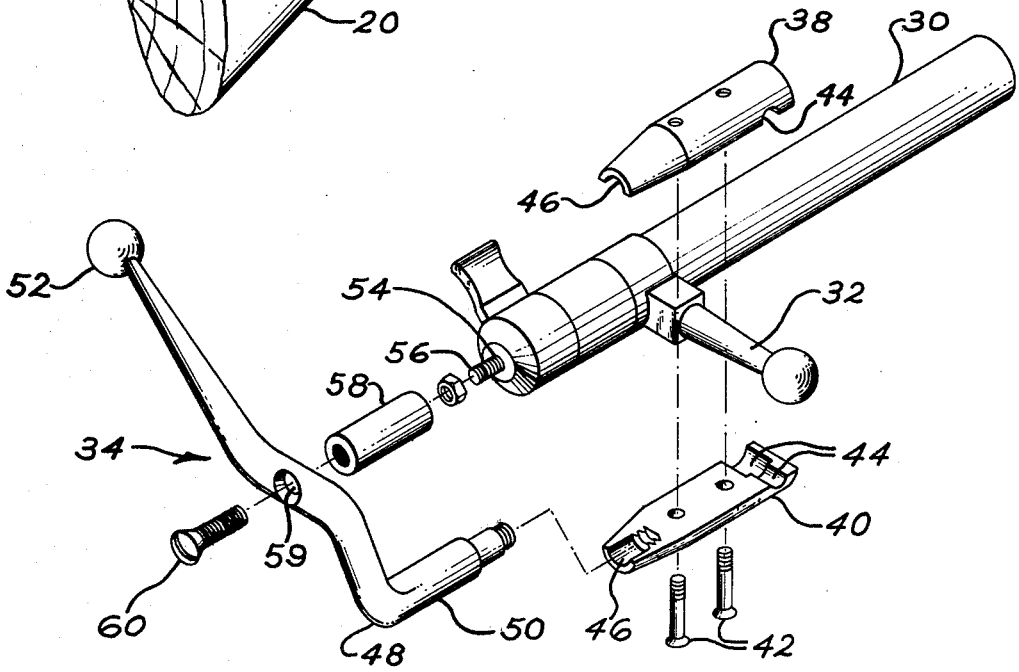
FIG. 2 is an exploded view of the bolt handle adaptor of FIG. 1.

Referring now to FIG. 2, there is attached to the chamber closing bolt a bolt handle adaptor means 34. Adaptor means 34 includes a bolt handle engagement means 36 which comprises two identical sections 38 and 40 held together by screws 42 to form a clamp around bolt handle 32. Sections 38 and 40 each include cutaway sections 44 of varying diameter so that when bolt handle engagement means 36 is clamped about the bolt handle increased gripping friction results therefrom. Sections 38 and 40 also include threaded portions 46 which provide for the attachment of sections 38 and 40 to the adaptor section 48.

Adaptor 48 includes a laterally projecting portion 50 on one end and a bulbous gripping portion 52 on the other. Adaptor 48 is shown to be L-shaped but can be any of a variety of shapes so long as the length of portion 50 in combination with sections 38 and 40 is at least as great as the distance from the bolt handle 32 to the distal end of the chamber closing bolt. Adaptor 48 also includes means for being pivotally mounted to the distal end of bolt 30. In this instance, an aperture 54 and screw 56 constitute the mounting means. Screw 56 may be passed through aperture 54 and in turn passed through aperture 59 to effect pivotal attachment of adaptor 48 thereto or an extension 58 may be provided. The extension 58 is then attached to the distal end of bolt 30 by screw means 56 and machine screw 60 is passed through aperture 59 to mount adaptor 48.

The invention disclosed herein provides for the conversion of a conventional right-hand operated bolt action rifle to a left-hand operated rifle. The conversion is accomplished by removing the firing pin indicator from the chamber closing bolt of the rifle. A machine screw in then inserted in place of the firing pin indicator with the threaded nut receiving portion projecting rearwardly from the distal end of the bolt. A nut is then tightened on the machine screw to secure it in position with respect to the bolt. An extension means is then located on the machine screw. Generally, the extension means is a hollow rod which is mounted or screwed concentrically onto the machine screw. Next, a bolt handle gripping means is fastened onto the bolt handle. This is accomplished by placing one of the identical sections 38 and 40 on one side of the bolt handle with its cutaway portion receiving the bolt handle shank. The opposite section of 38 and 40 is then placed in overlying relationship to the first and the two are fastened together with screws 42.

Then, a bolt handle adaptor 48 is attached to the bolt handle gripping means by screwing its threaded end into the threaded hole formed by threaded portions 46. Adaptor 48 is tightened into the combined sections until the bolt handle, the bolt and the adaptor all lie in a single plane as shown in FIG. 1. Finally, the adaptor is pivotally secured in abutting relationship to the extension by a machine screw 60. The assembly is then placed in operating position with the gripping portion of the adaptor projecting to the left-hand side of the rifle for actuation of the bolt from that side.

It should be noted that the above arrangement and conversion method have been described with respect to use of the invention on a standard model 1407 Anschutz small bore target rifle. The invention is, however, applicable to other rifles of similar basic construction in the same manner as outlined.

Having thus described the invention, what is claimed is:

1. In a conventional right-hand operated bolt action rifle, having a chamber, a bolt for closing said chamber and a bolt handle attached to said bolt, a bolt handle adaptor for reloading of said rifle from the left side thereof, said bolt handle adaptor comprising:

mounting means attached to the distal end of the rifle's chamber closing bolt;

an adaptor having first and second ends, said adaptor being pivotally mounted to said mounting means intermediate its first and second ends, said adaptor further terminating in a gripping portion at its first distal end on the left side of the rifle and including a laterally projecting section immediate to its second end on the right side of the rifle;

a bolt handle engaging means attched to said second end of said adaptor and engaged with the bolt handle of said rifle, said adaptor being further defined in that said laterally projecting section and said bolt handle engaging means in combination project laterally a distance at least equal to the distance from the distal end of said bolt to said bolt handle and said adaptor further lying in the horizontal plane defined by the longitudinal axis of said chamber closing bolt and the longitudinal axis of said bolt handle, when the bolt action is in its open position.

2. The bolt handle adaptor claim 1 wherein said gripping portion of said adaptor includes a bulbous gripping portion.

3. the bolt handle adaptor of claim 1 wherein said mounting means comprise a screw threaded fastening bolt affixed to said chamber closing bolt, a spacer on said fastening bolt and a second screw threaded attachment means projecting through an orifice in said adaptor and into said spacer.

4. The bolt handle adaptor of claim 1 wherein said bolt handle engaging means includes a two section clamp encompassing said bolt handle, said sections being removably secured together by screw fasteners.

5. The bolt handle adaptor of claim 4 wherein said bolt handle engaging means is attached to said second end of said adaptor by screw threads.

6. The bolt handle adaptor of claim 5 wherein said sections include aperture portions of varying diameter, said aperture portions forming an aperture containing said bolt handle when said sections are secured together with said varying diameters providing varying gripping forces exerted upon said bolt handle.

7. A method of converting a right-hand operated bolt action rifle having a chamber and a chamber closing bolt including a firing pin, a firing pin indicator and a bolt handle attached to said bolt, into a left-hand operated rifle comprising:

removing the firing pin indicator from the chamber closing bolt of said rifle;

inserting a machine screw in place of said firing pin indicator;

tightening a nut onto said machine screw;

locating an extension means on said machine screw;

fastening a bolt handle gripping means onto said bolt handle of said chamber closing bolt;

attaching a bolt handle adaptor to said bolt handle gripping means; and, pivotally mounting said bolt handle adaptor to said machine screw intermediate the bolt handle adaptor ends in abutting relationship to said extension means with said opposite end of said bolt handle adaptor projecting to the left-hand side of said rifle.

* * * * *